US012593875B2

(12) United States Patent
Ouyang

(10) Patent No.: US 12,593,875 B2
(45) Date of Patent: Apr. 7, 2026

(54) POWER SUPPLY FOR AEROSOL GENERATOR AND AEROSOL GENERATOR HAVING THE SAME

(71) Applicant: HONG KONG IVPS INTERNATIONAL LIMITED, Central (HK)

(72) Inventor: Junwei Ouyang, Shenzhen (CN)

(73) Assignee: HONG KONG IVPS INTERNATIONAL LIMITED, Central (HK)

( * ) Notice: Subject to any disclaimer, the term of this patent is extended or adjusted under 35 U.S.C. 154(b) by 560 days.

(21) Appl. No.: 18/095,126

(22) Filed: Jan. 10, 2023

(65) Prior Publication Data

US 2023/0232908 A1 Jul. 27, 2023

(30) Foreign Application Priority Data

Jan. 22, 2022 (CN) ..... 202220178574.8

(51) Int. Cl.
*A24F 40/51* (2020.01)
*A24F 40/485* (2020.01)

(52) U.S. Cl.
CPC ..... *A24F 40/51* (2020.01); *A24F 40/485* (2020.01)

(58) Field of Classification Search
CPC ..... A24F 40/485; A24F 40/10; A24F 40/51; A24F 40/50; A24F 40/40; A24F 40/53
See application file for complete search history.

(56) References Cited

U.S. PATENT DOCUMENTS

2021/0045444 A1* 2/2021 Liu ..... A24F 40/44
2023/0232908 A1* 7/2023 Ouyang ..... A24F 40/485 131/329

* cited by examiner

*Primary Examiner* — Michael H. Wilson
*Assistant Examiner* — Stephanie Lynn Moore
(74) *Attorney, Agent, or Firm* — Thompson Hine LLP

(57) ABSTRACT

The present disclosure provides a power supply for an aerosol generator and an aerosol generator having the same. The power supply may include a power supplying main body including a mounting chamber, a pneumatic switch, a seal seat, and an adjusting element. The seal seat may be in socket joint with the pneumatic switch and may be accommodated in the mounting chamber, and a peripheral part of the seal seat may be elastically abutted against the wall of the mounting chamber. One end of the mounting chamber may include an inlet hole which communicates the air supplying end of the pneumatic switch with ambient air, and the other end is provided with the vent hole which may communicate the sensing end of the pneumatic switch with ambient air. The adjusting element may be rotatably connected to the power supplying main body.

18 Claims, 4 Drawing Sheets

POWER SUPPLY FOR AEROSOL GENERATOR AND AEROSOL GENERATOR HAVING THE SAME

CROSS-REFERENCE TO RELATED APPLICATION

This application claims priority to Chinese Patent Application No. 202220178574.8 filed on Jan. 22, 2022, which is incorporated herein by reference in its entirety.

TECHNICAL FIELD

The present disclosure relates to the technical field of a power supply for aerosol generator and aerosol generator having the same.

BACKGROUND

An aerosol generator comprises two parts: a power supply and an atomizing device, wherein a battery component is arranged in the power supply to supply power for the atomizing device. In prior art, an integrated aerosol generator is formed through assembling the atomizing device loaded with oil with the power supply, which achieves WYSIWYG (What You See Is What You Get) and makes it easier to use. At the same time, power output of the battery component can be triggered and applied on the atomizing device during user inhaling through configuring a pneumatic switch in the power supply, to achieve ignition. However, these pneumatic switches may be triggered by mistake during assembly, transportation or use, which lead to output of battery component by mistake, resulting in dry heating of the heating element in the atomizing device, or denature of juice under heating, cause safety problem for users.

Therefore, the existing technique need to be modified and improved.

SUMMARY

The main purpose of the utility model is to provide a power supply for aerosol generator and aerosol generator having the same, intending to prevent the pneumatic switch from being triggered by mistake.

The technical solution adopted by the present invention to achieve the above purpose is provided as follows.

A power supply for aerosol generator, which comprises a power supplying main body equipped with a mounting chamber, a pneumatic switch, a seal seat and an adjusting element. The seal seat is in socket joint with the pneumatic switch and is accommodated in the mounting chamber, and peripheral part of the seal seat is elastically abutted against the wall of the mounting chamber. One end of the mounting chamber is provided with an inlet hole which communicate the air supplying end of the pneumatic switch with ambient air, and the other end is provided with the vent hole which communicate the sensing end of the pneumatic switch with ambient air. The adjusting element is rotatably connected to the power supplying main body. One end of the adjusting element corresponding to the sensing end extends into the mounting chamber, and the other end extends out of the power supplying main body. Communicating or separating the sensing end of the pneumatic switch with vent hole by turning the adjusting element, so as to communicate or separate the sensing end with ambient air.

For the power supply for aerosol generator mentioned above, when the sensing end of the pneumatic switch is completely covered by rotating the adjusting element, the sensing end and the vent hole will be separated to lock the pneumatic switch.

For the power supply for aerosol generator mentioned above, when the adjusting element is rotated to expose the sensing end of the pneumatic switch so that at least part of the sensing end is exposed in the mounting chamber, the sensing end communicates the vent hole to unlock the pneumatic switch.

For the power supply for aerosol generator mentioned above, the adjusting element comprises a stop block and a rotating shaft, the stop block is accommodated in the mounting chamber and fit to the seal seat. One end of the rotating shaft rotatably pass through the power supplying main body and is fixedly connected to the stop block, and the other end extends out of the power supplying main body. When the end which extends out of the power supplying main body is forced to rotate, the stop bock is driven to rotate relative to the seal seat to cover or expose the sensing end.

For the power supply for aerosol generator mentioned above, the rotating shaft is misaligned with the sensing end, and is eccentrically arranged with the stop block.

For the power supply for aerosol generator mentioned above, the power supplying main body is provided with a rotation hole matching with the rotating shaft, the rotating shaft rotatably pass through the rotation hole, the outer circumference of the rotating shaft is convexly provided with a limit bump, the inner wall of the rotation hole is provided with an annular clearance groove, the limit bump is accommodated in the annular clearance groove and can rotate along the circumferential direction of the annular clearance groove.

For the power supply for aerosol generator mentioned above, the rotating shaft comprises a rotating shaft body which run through the power supplying main body, a knob coaxially connected with the rotating shaft body and a seal, the knob is arranged on the outer side of the power supplying main body and fits with the peripheral part of the power supplying main body, the seal is fastened on the side of the power supplying main body on which the know fit with the power supplying main body and is clamped between the power supplying main body, the rotating shaft main body and the knob.

For the power supply for aerosol generator mentioned above, the seal seat is provided with a through-hole for installation, a first end of the through-hole for installation communicates with the inlet hole, a second end of the through-hole for installation communicates with the vent hole. The pneumatic switch is accommodated in the through-hole for installation, and the air supplying end exposes on the first end, and the sensing end exposes on the second end. When the adjusting element rotate to the position that the second end is blocked, the sensing end and the vent hole will be separated.

For the power supply for aerosol generator mentioned above, the second end is provided with a convex ring which is convexly arranged on the seal seat. When the adjusting element rotate to the position that the second end is blocked, the adjusting element is elastically abutted against the convex ring.

An aerosol generator, which comprises any of the power supply for aerosol generators mentioned above.

Beneficial effect: the present utility model provides a power supply for aerosol generator and aerosol generator having the same. The power supply comprises a power supplying main body equipped with a mounting chamber, a pneumatic switch, a seal seat and an adjusting element. The seal seat is in socket joint with the pneumatic switch and is accommodated in the mounting chamber, and peripheral part of the seal seat is elastically abutted against the wall of the mounting chamber. One end of the mounting chamber is provided with an inlet hole which communicate the air supplying end of the pneumatic switch with ambient air, and the other end is provided with the vent hole which communicate the sensing end of the pneumatic switch with ambient air. The adjusting element is rotatably connected to the power supplying main body. One end of the adjusting element corresponding to the sensing end extends into the mounting chamber, and the other end extends out of the power supplying main body. Communicating or separating the sensing end of the pneumatic switch with vent hole by turning the adjusting element, so as to communicate or separate the sensing end with ambient air. Opening and closing of the vent hole at the sensing end of the pneumatic switch can be controlled by turning the adjusting element, so as to unlock and lock the pneumatic switch and prevent the pneumatic switch from being triggered by mistake.

DESCRIPTION OF THE DRAWINGS

For a more complete understanding of present disclosure, or the technical schemes in the prior art, the drawings in the embodiments or the description of the prior art are briefly introduced. Obviously, the drawings in the following descriptions are only some embodiments of present disclosure. It will be apparent to those skilled in the art from this disclosure that other drawings may be easily obtained from these drawings without paying any creative effort.

DEFINITION OF REFERENCE NUMBERS

Figure 1:
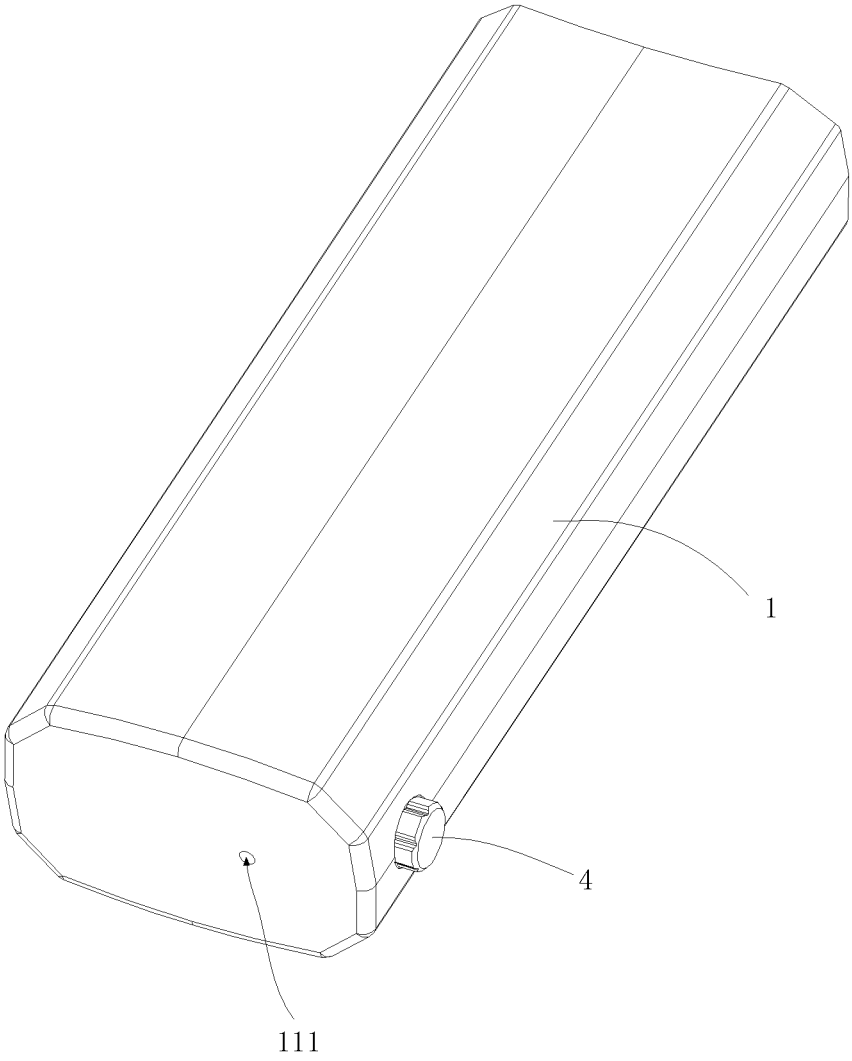
FIG. 1 is the perspective view of some embodiments of the power supply for aerosol generator disclosed in the present utility model.

| Reference number | Name | Reference number | Name |
|---|---|---|---|
| 1 | Power supplying main body | 2 | Pneumatic switch |
| 3 | Seal seat | 4 | Adjusting element |
| 11 | Housing | 12 | Support |
| 13 | Sealing chamber | 14 | Rotation hole |
| 15 | Battery component | 111 | Vent hole |
| 121 | Seat body | 122 | First upright column |
| 123 | Second upright column | 131 | air inlet hole |
| 132 | Vent hole | 21 | Air supplying end |
| 22 | Sensing end | 31 | Through-hole for mounting |
| 311 | First end | 312 | Second end |
| 32 | Convex ring | 41 | Rotating shaft |
| 42 | Stop block | 411 | Rotating shaft body |
| 412 | Knob | 413 | Seal |
| 141 | Clearance groove | 414 | Limit bump |

The realization of the objects, functional characteristics and advantages of the present invention will be further described in conjunction with the embodiments and with reference to the drawings.

DETAILED DESCRIPTION

Technical solutions according to embodiments of the present invention are described clearly and completely in conjunction with the drawings in the embodiments of the present invention hereinafter. Apparently, the described embodiments are only a few rather than all of the embodiments of the present invention. Other embodiments obtained by those skilled in the art without any creative work based on the embodiments of the present invention fall within the scope of protection of the present invention.

It should be noted that all directional indicators (such as up, down, left, right, front, back, etc.) in the embodiments of the present invention are only used to explain the relative position between the components in a specific posture (as shown in the drawings) and movement conditions, etc., if the specific posture changes, the directional indication also changes accordingly.

In the description of the present application, the "first", "second" are merely used for description, and cannot be understood to indicate or imply relative importance or implicitly indicate the number of the indicated technical features. Therefore, features with a limitation of "first" or "second" can explicitly or implicitly include one or more feature. Furthermore, technical schemes of various embodiments can be combined with each other if only it can be implemented by those of ordinary skill in the art. If a combination of the technical schemes is conflict or impracticable, the combination should be considered as not exist, and not fall in the scope of protection of the present invention.

In the present invention, unless otherwise clearly stated and limited, terms "connect" and "fix" should be understood broadly, for instance, "fix" can be a fixed connection, a detachable connection or an integral connection; can be a mechanical connection, also can be an electrical connection; can be a direct connection, can also be an indirect connection by an intermediary, can be an internal communication of two elements, unless otherwise clearly limited. A person skilled in the art can understand concrete meanings of the terms in the present invention as per specific circumstances.

Refer to FIG. 1-FIG. 5, the present utility model discloses a power supply for aerosol generator, which comprises a power supplying main body 1, a pneumatic switch 2, a seal seat 3 and an adjusting element 4. The power supplying main body 1 is equipped with a mounting chamber 13, the seal seat 3 is in socket joint with the pneumatic switch 2 and is accommodated in the mounting chamber 13, and peripheral part of the seal seat 3 is elastically abutted against the wall of the mounting chamber 13. One end of the mounting chamber 13 is provided with an inlet hole 131 which communicate the air supplying end 21 of the pneumatic switch 2 with ambient air, and the other end is provided with the vent hole 132 which communicate the sensing end 22 of the pneumatic switch 2 with ambient air. The adjusting element 4 is rotatably connected to the power supplying main body 1. One end of the adjusting element corresponding to the sensing end 22 extends into the mounting chamber 13, and the other end extends out of the power supplying main body 1. Communicating or separating the sensing end 22 of the pneumatic switch with vent hole 132 by turning the adjusting element 4, so as to communicate or separate the sensing end 22 with ambient air, unlock and lock the pneumatic switch 2 and prevent the pneumatic switch 2 from being triggered by mistake.

Figure 2:
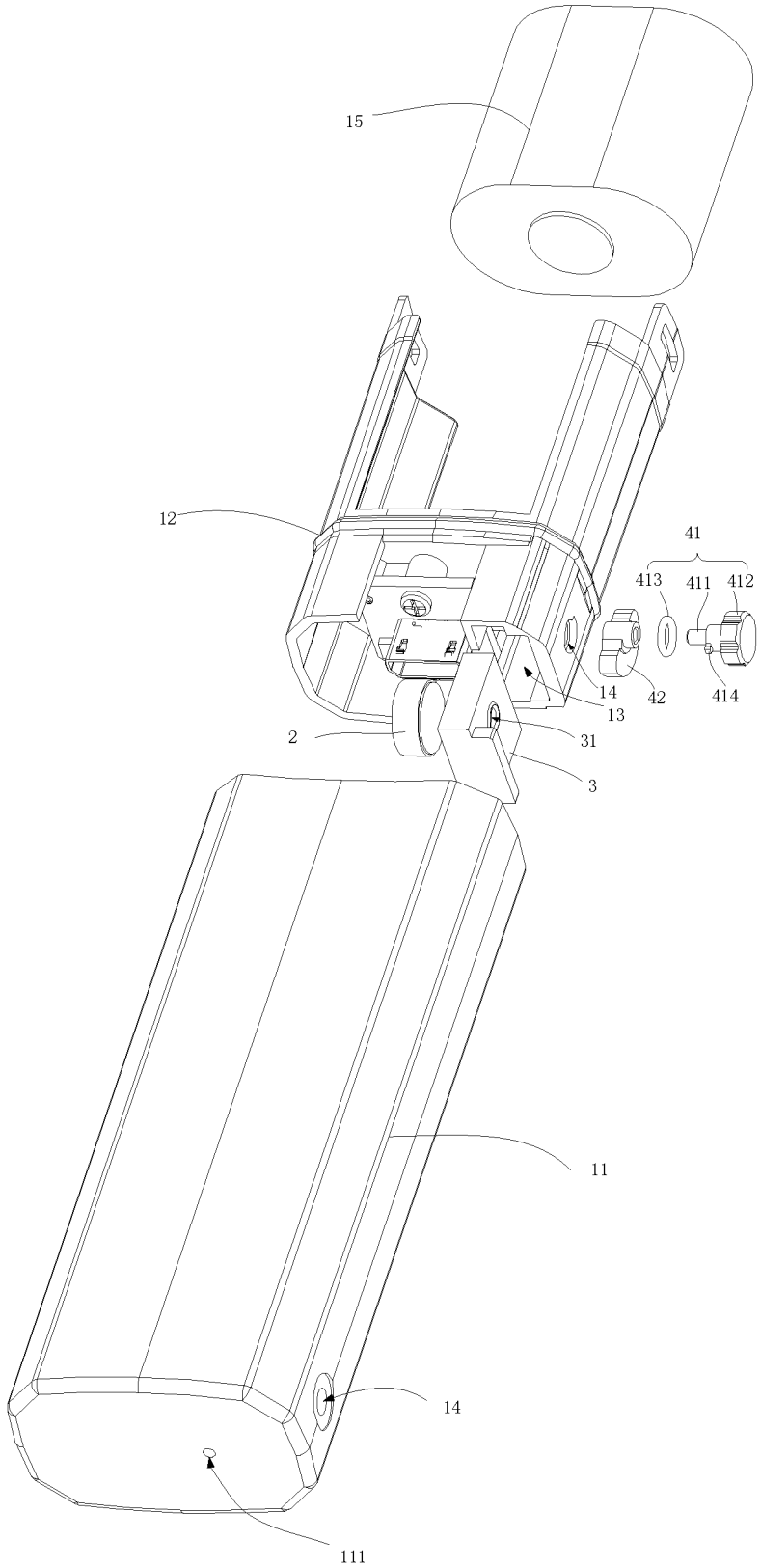
FIG. 2 is the exploded view of some embodiments of the power supply for aerosol generator disclosed in the present utility model.

In some embodiments, as shown in FIG. 1 to FIG. 2, the power supplying main body 1 comprises a housing 11 and a battery component 15 accommodated in the housing 11. The housing 11 is in a hollow structure, and the battery component 15 is accommodated in the housing 11. A mounting part for mounting the atomizing device is provided on one side of the housing 11 where the battery component 15 is located, and the other side of the battery component 15 is provided with a mounting chamber 13. The mounting chamber may communicate with the mounting part through the vent hole 132 and the gap between the battery component 15 and the housing 11. The housing 11 is provided with a vent hole 111 which communicates with the inlet hole 131. When the atomizing device is loaded on the mounting part, ambient air may enter the mounting chamber 13 through the vent hole 111 and the inlet hole 131 in turn, subsequently pass through the pneumatic switch 2 in the mounting chamber 13 and flow out the mounting chamber 13 through the vent hole 132, and trigger the pneumatic switch 2 at the same time, then enter the atomizing device through the gap and the mounting part and participate atomization, finally produce aerosol to flow out into the ambient air for users to smoke. Of course, the mounting part and the mounting chamber 13 may also be located on the same side of the battery component 15, which is not limited herein.

Figure 3:
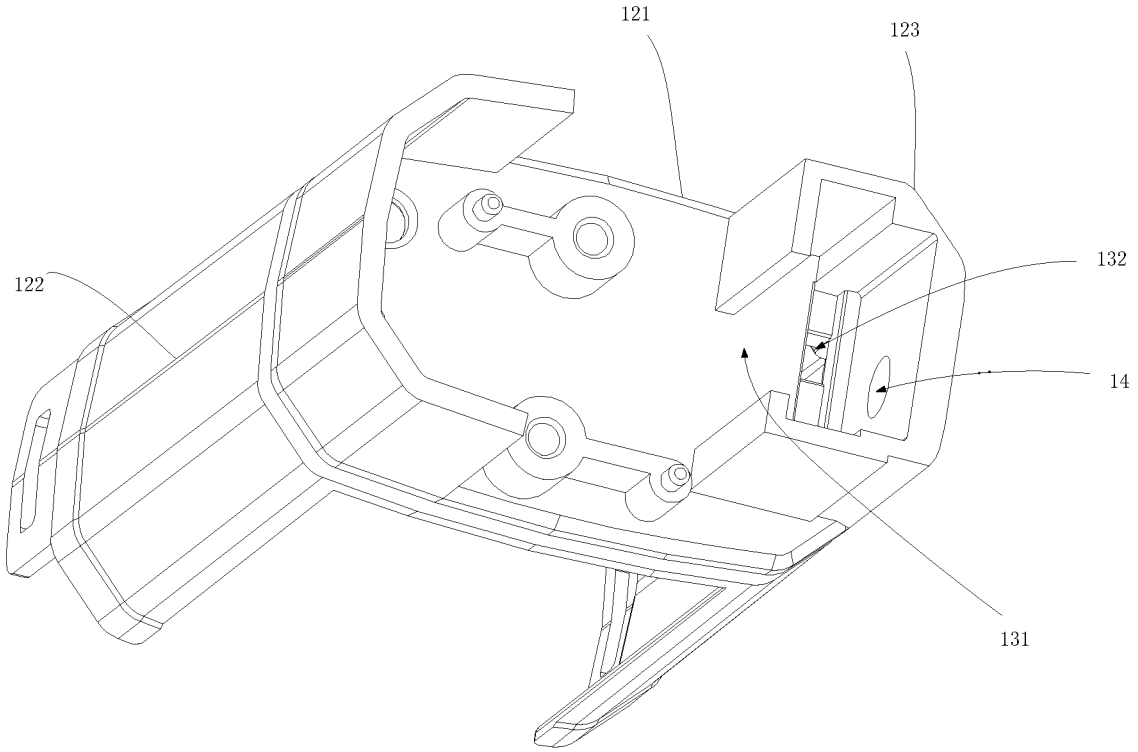
FIG. 3 is the schematic view of the support in the perspective view of some embodiments of the power supply for aerosol generator disclosed in the present utility model.

In some embodiments, as shown in FIG. 3, the battery component 15 can be fixed through arranging a support 12 in the housing 11. The support 12 comprises a seat body 121, one end of the seat body 121 protrudes with a first upright column 122, and the first upright column 122 and the seat body 121 form a space for placing the battery component 15. The end of the first upright column 122 which is away from the seat body 121 form the mounting part along with the housing 11, and the atomizing device is fixed by the mounting part. The end of the seat body 121 away from the first upright column 122 protrudes with the second upright column 123, and the second upright column 123 forms a tubular structure. When the support 12 is mounted in the housing 11, the second upright column 123 is hold between the housing 11 and the seat body 121, and the housing 11 and the seat body 121 forms a closed installation chamber 13. The seat body 121 is provided with a vent hole 132 which connects the mounting part with the mounting chamber 13. One side of the second upright column 123 is provided with the inlet hole 131, and the other side attaches to the housing 11. Subsequent adjusting element 4 passes through the second upright column 123 and the housing 11 in turn and is rotationally connected to the power supplying main body 1.

In some embodiments, the pneumatic switch 2 may adopt a pressure sensor, which includes an air supplying end 21 and a sensing end 22. An air collecting chamber is provided between the air supplying end 21 and the sensing end 22. The air supplying end 21 is provided with an air supplying port matched with the air collecting chamber. The sensing end 22 is provided with a sensing diaphragm and an air outlet port communicated with the gas collecting chamber. That is, the air supplying port, the gas collecting chamber and the air outlet port are sequentially connected to form an internal air passage of the pneumatic switch 2. Ambient air enters the air collecting chamber through the air supplying port, then flow out through the air outlet port, driving the sensing diaphragm to deform during the outflow process, thus generating an electrical signal and transmitting the electrical signal to the power supplying main body 1. In practice, the pneumatic switch 2 could be an integrated pressure sensor, in which a micro control circuit is integrated, so that the power supplying main body 1 does not need to be configured with control elements, and investment cost on equipment can be reduced. Of course, the pneumatic switch 2 can adopt a non-integrated pressure sensor. By setting a control element in the power supplying main body 1, the pneumatic switch 2 is electrically connected to the control element to transmit electrical signals.

Figure 4:
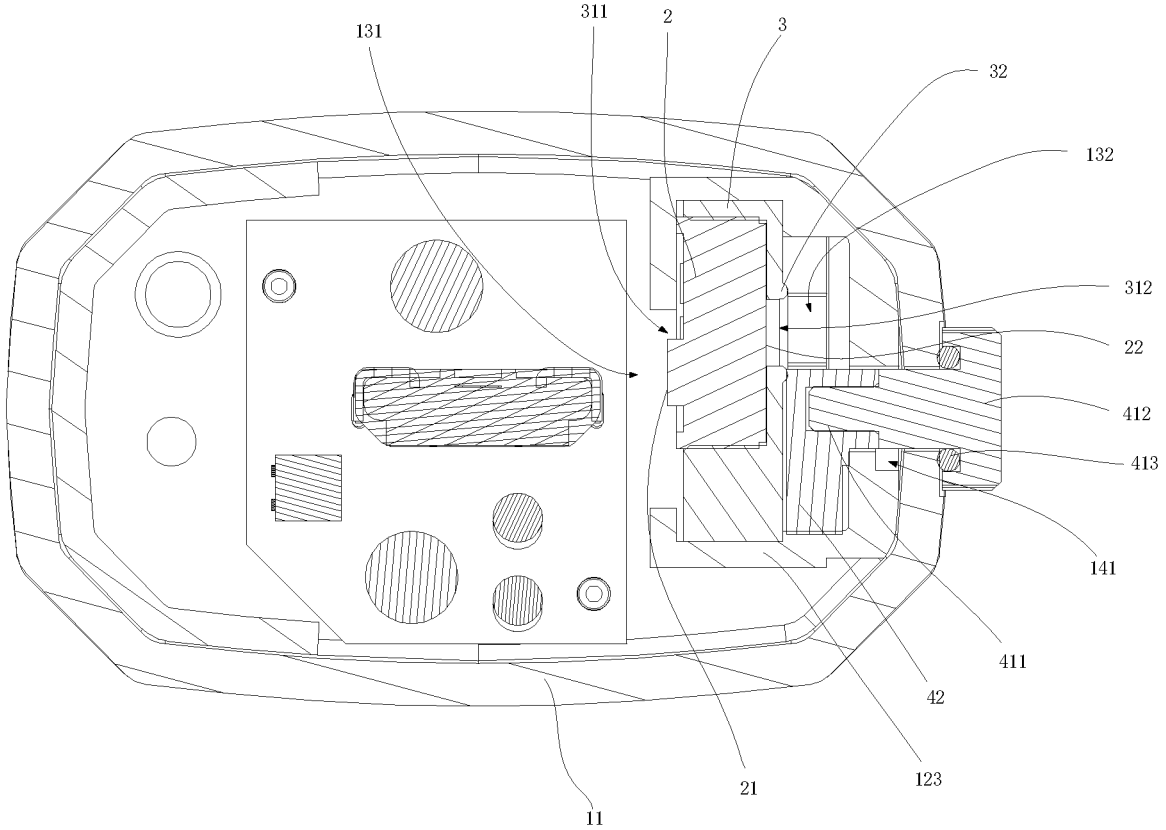
FIG. 4 is the section view of locked pneumatic switch in some embodiments of the power supply for aerosol generator disclosed in the present utility model.
Figure 5:
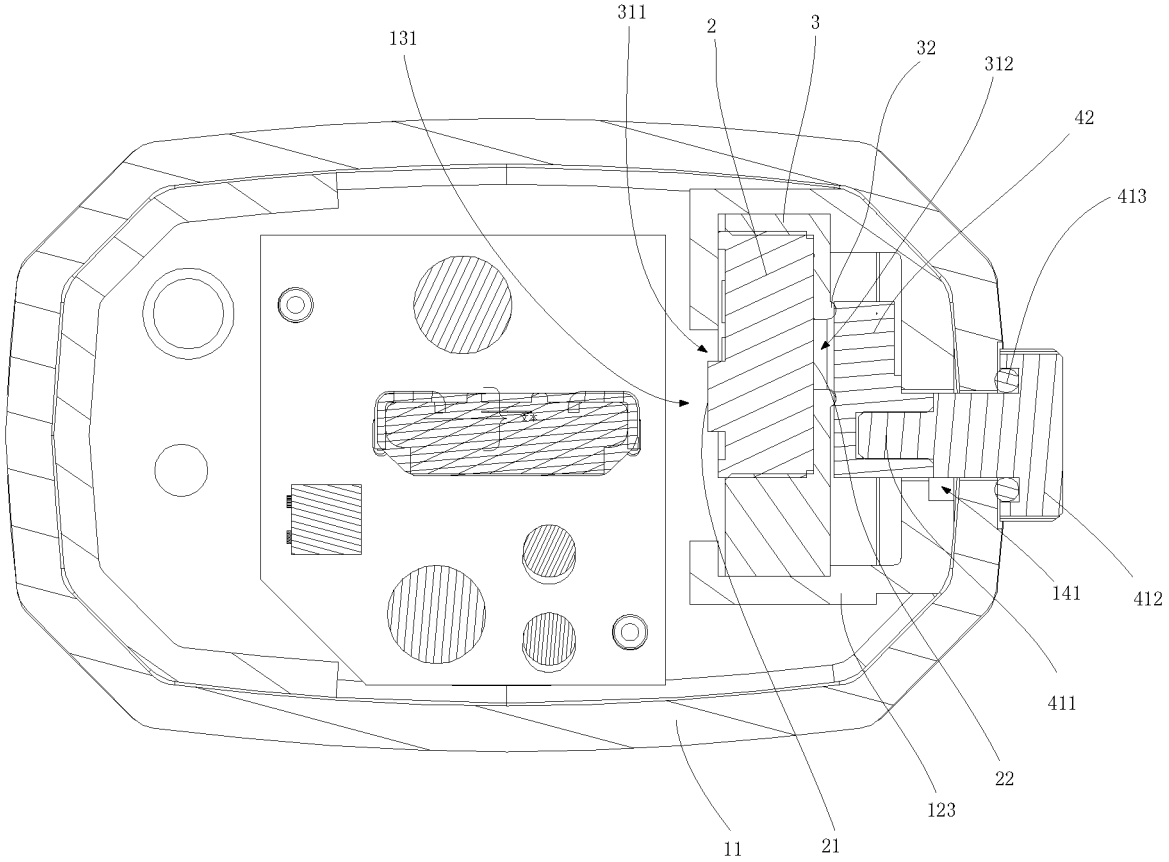
FIG. 5 is the section view of unlocked pneumatic switch in some embodiments of the power supply for aerosol generator disclosed in the present utility model.

In some embodiments, as shown in FIG. 2, FIG. 4 and FIG. 5, the shape of the seal seat 3 matches the shape of the mounting chamber 13. When the seal seat 3 is accommodated in the mounting chamber 13, the peripheral part of the seal seat 3 is elastically abutted against the wall of the mounting chamber 13 to fill the gap between the seal seat 3 and the mounting chamber 13, and prevent ambient air from flowing through the mounting chamber 13 and entering the power supplying main body 1 through the gap. The seal seat 3 is provided with a through-hole for mounting 31 for mounting the pneumatic switch 2. The through-hole for mounting 31 comprise a first end 311 and a second end 312. Correspondingly, one end of the wall of the mounting chamber 13 is provided with an inlet hole 131 which communicate the first end 311 with ambient air, and the other end is provided with the vent hole 132 which communicate the second end 312 with ambient air. The pneumatic switch 2 is accommodated in the through-hole for mounting 31, and the air supplying end 21 communicates with the first end 311, and the sensing end 22 communicates with the second end 312. In this way, ambient air, the air inlet hole 131, the first end 311, the air supplying end 21, the air collecting chamber of the pneumatic switch 2, the sensing end 22, the second end 312, the vent hole 132 and the mounting part (ambient air) communicate in turn, thus forming the triggering channel of the pneumatic switch 2. In practice, the sensing end 22 can be completely exposed to the second end 312; or partly exposed to the second end 312.

In some embodiments, as shown in FIG. 2, FIG. 3 and FIG. 5, the adjusting element 4 comprises a stop block 42 and a rotating shaft 41. The stop block 42 is accommodated in the mounting chamber 13 and is attached to one side of the second end 312 of the seal seat 3 with the through-hole for mounting 31. Correspondingly, there is a gap between the side of the seal seat 3 with the second end 312 and the wall of the mounting chamber 13. The stop block 42 is accommodated in the gap. The thickness of the stop block 42 is less than or equal to the width of the gap. Preferably, the thickness of the stop block 42 is equal to the width of the gap, that is, one side of the stop block 42 is attached to the seal seat 3, and the other side is attached to the wall of the mounting chamber 13. The stop block 42 is limited by the gap to prevent displacement of the stop block 42 along the axial direction of the rotating shaft 41. In practice, a limit boss can also be arranged on the stop block 42, and a matching limit groove can be arranged on the chamber wall forming the gap. The displacement of the stop block 42 along the direction of vertical rotating shaft can be limited by clamping the limit boss into the limit groove.

In some embodiments, the rotating shaft 41 rotatably pass through the power supplying main body 1, and one end of the rotating shaft 41 is fixedly connected to the side of the stop block 42 away from the seal seat 3, and the other end extends out of the power supplying main body 1 for user operation. Correspondingly, the power supplying main body 1 is provided with a rotation hole 14 matched with the rotating shaft 41. The rotating shaft 41 passes through the rotation hole 14 and can rotate with respect to the rotation hole 14. Furthermore, the peripheral part of the rotating shaft 41 is convexly provided with a limit bump 414, and the inner wall of the rotation hole 14 is provided with an annular clearance groove 141 along the circumferential direction. The limit bump 414 is accommodated in the clearance groove 141 and can rotate along the circumferential direction of the clearance groove 141. The matching between the limiting bump 414 and the clearance groove 141 not only limit the rotating shaft 41 and prevent the displacement of the rotating shaft 41 along the axial direction, but also guide the rotation of the rotating shaft 41.

When the rotating shaft 41 rotates under force, the stop block 42 is driven by the rotating shaft 41 to rotate with respect to the seal seat 3. When the stop block 42 rotates to the position where the first end 311 of the through-hole for mounting 31 is blocked, the sensing end 22 is blocked, thus separate with the vent hole 132, so that the air at the sensing end 22 cannot enter into ambient air, and the sensing end 22 cannot be driven to produce deformation. At this time, the pneumatic switch 2 cannot be triggered and is under locked state. In this way, when the user does not need to use the equipment, he only needs to turn the adjusting element 4 to the locked state, and the pneumatic switch 2 cannot be triggered, which greatly reduces the risk of the pneumatic switch 2 being triggered by mistake. When the stop block 42 rotates to the position where the first end 311 is not blocked, the sensing end 22 communicates with ambient air through the vent hole 132, so that the air at the sensing end 22 can flow out smoothly, and drive the sensing end 22 to deform. At this time, the pneumatic switch 2 can be triggered, that is, it is under unlocked state. Through rotating the adjusting element 4, the sensing end 22 and the vent hole 132 can be separated or communicated, so as to lock and unlock the pneumatic switch 2, which is easy to operate.

In some embodiments, as shown in FIG. 4 and FIG. 5, the rotating shaft 41 is misaligned with the sensing end 22, and is eccentrically arranged with the stop block 42. That is, the projection area of the rotating shaft 41 on the seal seat 3 does not overlap with the sensing end 22, and the rotating shaft 41 does not pass through the center of the stop block 42. In this way, the sensing end 22 and the stop block 42 are both eccentrically arranged relative to the rotating shaft 41, so that the projection area of the stop block 42 completely cover the sensing end 22 to block the sensing end 22 when the rotating shaft 41 drives the stop block 42 to rotate. Correspondingly, the peripheral dimension of the stop block 42 is larger than that of the sensing end 22. In practice, the stop block 42 may be in the shape of a sector, rectangle, square, ellipse or other structure.

Of course, the rotating shaft 41 can also be misaligned with the first end 311, that is, the first end 311 and the stop block 42 are both eccentrically arranged relative to the rotating shaft 41, and the first end 311 can be completely blocked by the stop block 42 to achieve the purpose of enclosing the sensing end 22. Correspondingly, the peripheral dimension of the stop block 42 is larger than that of the first end 311. Furthermore, the second end 312 is provided with a convex ring 32 protruding to the surface of the seal seat 3. When the rotating shaft 41 drives the stop block 42 to block the first end 311, the stop block 42 is elastically abutted against the convex ring 32 to increase the force between the stop block 42 and the first end 311, improve the result of sealing, and thus improve the reliability of locking.

In some embodiments, the rotating shaft 41 comprises a rotating shaft body 411, a knob 412 and a seal 413. The rotating shaft body 411 passes through the rotation hole 14, and one end is connected to the stop block 42, and the other end is coaxially connected to the knob 412. The rotating shaft body 411 is in a columnar structure. When the knob 412 rotates under force, the rotating shaft body 411 is driven to rotate around the central axis of the rotating shaft body 411. The knob 412 is located outside the power supplying main body 1 and is attached to the periphery of the power supplying main body 1. The seal 413 is fastened to one side of the knob 412 where the power supplying main body 1 is attached to, and is clamped among the power supplying main body 1, the rotating shaft 41 and the knob 412 to seal the gap between the power supplying main body 1 and the rotating shaft 41, realize the sealing of the mounting chamber 13, and prevent the air in the mounting chamber 13 from flowing out of the gap, causing the pneumatic switch 2 to be triggered by mistake. In practice, the seal 413 can be a seal ring. A groove around the rotating shaft 41 is arranged on one side of the knob 412 which is connected to the rotating shaft body 411, and the groove and the rotating shaft 41 enclose to form an annular groove matching the seal ring. The sealing ring is accommodated in the annular groove, and is elastically abutted against the knob 412, the power supplying main body 1 and the rotating shaft body 411 respectively.

The present utility model also discloses an aerosol generator. The aerosol generator comprises any of the power supply for aerosol generator mentioned above. The specific structure of the power supply for aerosol generator refers to above mentioned embodiment. The aerosol generator adopts all the technical schemes of all above embodiments, therefore at least shows all the beneficial effects brought by the technical schemes of the above embodiments, which will not be repeated here.

The above only describes preferred embodiments of the present invention and is not intended to limit the patent scope of the present invention. Any equivalent structural transformation made by using contents of the description and drawings of the present invention, or directly or indirectly used in other relevant technical fields under the inventive concept of the present invention shall be included within the protection scope of patent of the present invention.

What is claimed is:

1. A power supply for an aerosol generator, the power supply comprising:

a power supplying main body comprising a mounting chamber;

a pneumatic switch;

a seal seat; and an adjusting element, wherein the seal seat is in socket joint with the pneumatic switch and is accommodated in the mounting chamber, wherein a peripheral part of the seal seat is elastically abutted against a wall of the mounting chamber, wherein one end of the mounting chamber power supplying main body is provided with an inlet hole which communicates an air supplying end of the pneumatic switch with ambient air, and another end is provided with a vent hole which communicates a sensing end of the pneumatic switch with ambient air, wherein the adjusting element is rotatably connected to the power supplying main body, wherein a first end of the adjusting element corresponding to a sensing end of the pneumatic switch extends into the mounting chamber, and a second end of the adjusting element extends out of the power supplying main body, and wherein the second end of the adjusting element communicates or separates the sensing end of the pneumatic switch with the vent hole by turning the adjusting element, so as to communicate or separate the sensing end of the pneumatic switch with ambient air.

2. The power supply of claim 1, wherein, when the sensing end of the pneumatic switch is covered by rotating the adjusting element, the sensing end of the pneumatic switch and the vent hole will be separated to lock the pneumatic switch.

3. The power supply of claim 1, wherein, when the adjusting element is rotated to release the sensing end of the pneumatic switch so that at least part of the sensing end of the pneumatic switch is exposed in the mounting chamber, the sensing end of the pneumatic switch communicates the vent hole to unlock the pneumatic switch.

4. The power supply of claim 1, wherein, the adjusting element comprises a stop block and a rotating shaft, wherein the stop block is accommodated in the mounting chamber and configured to fit to the seal seat, wherein a first end of the rotating shaft rotatably passes through the power supplying main body and is fixedly connected to the stop block, and a second end of the rotating shaft extends out of the power supplying main body, wherein, when the second end of the rotating shaft is forced to rotate, the stop block is driven to rotate relative to the seal seat to cover or expose the sensing end of the pneumatic switch.

5. The power supply of claim 4, wherein, when the rotating shaft is misaligned with the sensing end of the pneumatic switch, the rotating shaft is eccentrically arranged with the stop block.

6. The power supply of claim 4, wherein the power supplying main body is provided with a rotation hole matching with the rotating shaft, wherein the rotating shaft rotatably passes through the rotation hole, wherein an outer circumference of the rotating shaft is convexly provided with a limit bump, wherein an inner wall of the rotation hole is provided with an annular clearance groove, and wherein the limit bump is accommodated in the annular clearance groove and can rotate along a circumferential direction of the annular clearance groove.

7. The power supply of claim 4, wherein the rotating shaft further comprises a rotating shaft body which runs through the power supplying main body, wherein the rotating shaft further comprises a knob coaxially connected with the rotating shaft body and a seal, wherein the knob is arranged on an outer side of the power supplying main body and fits with a peripheral part of the power supplying main body, wherein a seal is fastened on the outer side of the power supplying main body on which the knob fits with the power supplying main body, and wherein the seal is clamped between the power supplying main body, the rotating shaft main body, and the knob.

8. The power supply of claim 4, wherein the seal seat comprises a through-hole for mounting, wherein a first end of the through-hole of the seal seat is for installation and communicates with the inlet hole, wherein a second end of the through-hole of the seal seat is for installation and communicates with the vent hole, wherein the pneumatic switch is accommodated in the through-hole for installation, wherein the air supplying end exposes on the first end of the rotating shaft, and the sensing end of the pneumatic switch exposes on the second end of the rotating shaft, wherein, when the adjusting element rotates to a position that a second end of the rotating shaft is blocked, the sensing end of the pneumatic switch and the vent hole will be separated.

9. The power supply of claim 8, wherein the second end of the rotating shaft comprises a convex ring which is convexly arranged on the seal seat, wherein, when the adjusting element rotates to the position that the second end of the rotating shaft is blocked, the adjusting element is elastically abutted against the convex ring.

10. An aerosol generator, the aerosol generator comprising:

a power supply, the power supply comprising:

a power supplying main body comprising a mounting chamber;

a pneumatic switch;

a seal seat; and an adjusting element, wherein the seal seat is in socket joint with the pneumatic switch and is accommodated in the mounting chamber, wherein a peripheral part of the seal seat is elastically abutted against a wall of the mounting chamber, wherein one end of the mounting chamber power supplying main body is provided with an inlet hole which communicates an air supplying end of the pneumatic switch with ambient air, and another end is provided with a vent hole which communicates a sensing end of the pneumatic switch with ambient air, wherein the adjusting element is rotatably connected to the power supplying main body, wherein a first end of the adjusting element corresponding to the sensing end of the pneumatic switch extends into the mounting chamber, and a second end of the adjusting element extends out of the power supplying main body, and wherein the second end of the adjusting element communicates or separates the sensing end of the pneumatic switch with the vent hole by turning the adjusting element, so as to communicate or separate the sensing end of the pneumatic switch with ambient air.

11. The aerosol generator of claim 10, wherein, when the sensing end of the pneumatic switch is covered by rotating the adjusting element, the sensing end of the pneumatic switch and the vent hole will be separated to lock the pneumatic switch.

12. The aerosol generator of claim 10, wherein, when the adjusting element is rotated to release the sensing end of the pneumatic switch so that at least part of the sensing end of the pneumatic switch is exposed in the mounting chamber, the sensing end of the pneumatic switch communicates the vent hole to unlock the pneumatic switch.

13. The aerosol generator of claim 10, wherein, the adjusting element comprises a stop block and a rotating shaft, wherein the stop block is accommodated in the mounting chamber and configured to fit to the seal seat, wherein a first end of the rotating shaft rotatably passes through the power supplying main body and is fixedly connected to the stop block, and a second end of the rotating shaft extends out of the power supplying main body, wherein, when the second end of the rotating shaft is forced to rotate, the stop block is driven to rotate relative to the seal seat to cover or expose the sensing end of the pneumatic switch.

14. The aerosol generator of claim 13, wherein, when the rotating shaft is misaligned with the sensing end of the pneumatic switch, the rotating shaft is eccentrically arranged with the stop block.

15. The aerosol generator of claim 13, wherein the power supplying main body is provided with a rotation hole matching with the rotating shaft, wherein the rotating shaft rotatably passes through the rotation hole, wherein an outer circumference of the rotating shaft is convexly provided with a limit bump, wherein an inner wall of the rotation hole is provided with an annular clearance groove, and wherein the limit bump is accommodated in the annular clearance groove and can rotate along a circumferential direction of the annular clearance groove.

16. The aerosol generator of claim 13, wherein the rotating shaft further comprises a rotating shaft body which runs through the power supplying main body, wherein the rotating shaft further comprises a knob coaxially connected with the rotating shaft body and a seal, wherein the knob is arranged on an outer side of the power supplying main body and fits with a peripheral part of the power supplying main body, wherein a seal is fastened on outer side of the power supplying main body on which the knob fits with the power supplying main body, and wherein the seal is clamped between the power supplying main body, the rotating shaft main body, and the knob.

17. The aerosol generator of claim 13, wherein the seal seat comprises a through-hole for mounting, wherein a first end of the through-hole of the seal seat is for installation and communicates with the inlet hole, wherein a second end of the through-hole of the seal seat is for installation and communicates with the vent hole, wherein the pneumatic switch is accommodated in the through-hole for installation, wherein the air supplying end exposes on the first end of the rotating shaft, and the sensing end of the pneumatic switch exposes on the second end of the rotating shaft, wherein, when the adjusting element rotates to a position that a second end of the rotating shaft is blocked, the sensing end of the pneumatic switch and the vent hole will be separated.

18. The aerosol generator of claim 17, wherein the second end of the rotating shaft comprises a convex ring which is convexly arranged on the seal seat, wherein, when the adjusting element rotates to the position that the second end of the rotating shaft is blocked, the adjusting element is elastically abutted against the convex ring.

* * * * *